United States Patent [19]

Harter et al.

[11] Patent Number: 4,601,146

[45] Date of Patent: Jul. 22, 1986

[54] POST COVER FOR SPACE DIVIDING WALL PANEL SYSTEM

[75] Inventors: Mark A. Harter, Hamilton; Raoul J. P. Schoumaker, Wyoming, both of Mich.

[73] Assignee: Westinghouse Electric Corp., Pittsburgh, Pa.

[21] Appl. No.: 582,207

[22] Filed: Feb. 21, 1984

[51] Int. Cl.[4] ..... E04H 1/00; E04B 1/00

[52] U.S. Cl. ..... 52/239; 52/243; 52/281; 52/282; 52/288

[58] Field of Search ..... 52/27, 238.1, 239–243, 52/243.1, 282, 287, 288, 290, 254, 281; 160/135, 351

[56] References Cited

U.S. PATENT DOCUMENTS

| | | | |
|---|---|---|---|
| 1,796,024 | 3/1931 | Hohler | 52/282 |
| 3,300,919 | 1/1967 | Hiller | 52/241 |
| 3,312,025 | 4/1967 | Deakins | 52/239 |
| 3,350,828 | 11/1967 | Russell | 52/281 |
| 3,411,252 | 11/1965 | Boyle, Sr. | 52/242 |
| 3,447,824 | 6/1969 | Brown | 52/281 |
| 3,616,587 | 11/1971 | Schlafly, Sr. | 52/288 |
| 3,712,003 | 1/1973 | Hallock et al. | 52/254 |
| 3,762,116 | 10/1973 | Anderson et al. | 52/239 |
| 3,877,191 | 4/1975 | Munsey | 52/632 |
| 3,971,182 | 7/1976 | Donahue et al. | 52/239 |
| 4,104,838 | 8/1978 | Hage et al. | 52/282 |
| 4,104,839 | 8/1978 | Balzer et al. | 52/288 |
| 4,229,917 | 10/1980 | Textoris et al. | 52/239 |
| 4,296,583 | 10/1981 | Egenlauf | 52/717 |
| 4,404,785 | 9/1983 | McCracken et al. | 52/290 |
| 4,424,654 | 1/1984 | Anderson et al. | 52/239 |
| 4,446,669 | 5/1984 | Siegal | 160/135 |
| 4,546,584 | 10/1985 | Mieyal et al. | 52/281 |

FOREIGN PATENT DOCUMENTS

| | | | |
|---|---|---|---|
| 2030891 | 7/1971 | Fed. Rep. of Germany | 52/239 |
| 1032103 | 6/1966 | United Kingdom | 52/288 |

*Primary Examiner*—John E. Murtagh
*Assistant Examiner*—Andrew J. Rudy
*Attorney, Agent, or Firm*—B. R. Studebaker

[57] ABSTRACT

A cover for enclosing the support post of a space dividing wall panel system is disclosed. The cover is planar and includes a pair of spaced, hook-shaped connectors on the inner surface thereof which coact with annular slots in the support post to mount the cover thereto. One or more of the covers may be mounted to a single post to thereby shield the post from view in most post and panel assembly configurations. The post cover may preferably include a cloth outer covering and a metal impregnated, magnetized vinyl strip on its inner surface.

7 Claims, 7 Drawing Figures

FIG. 1
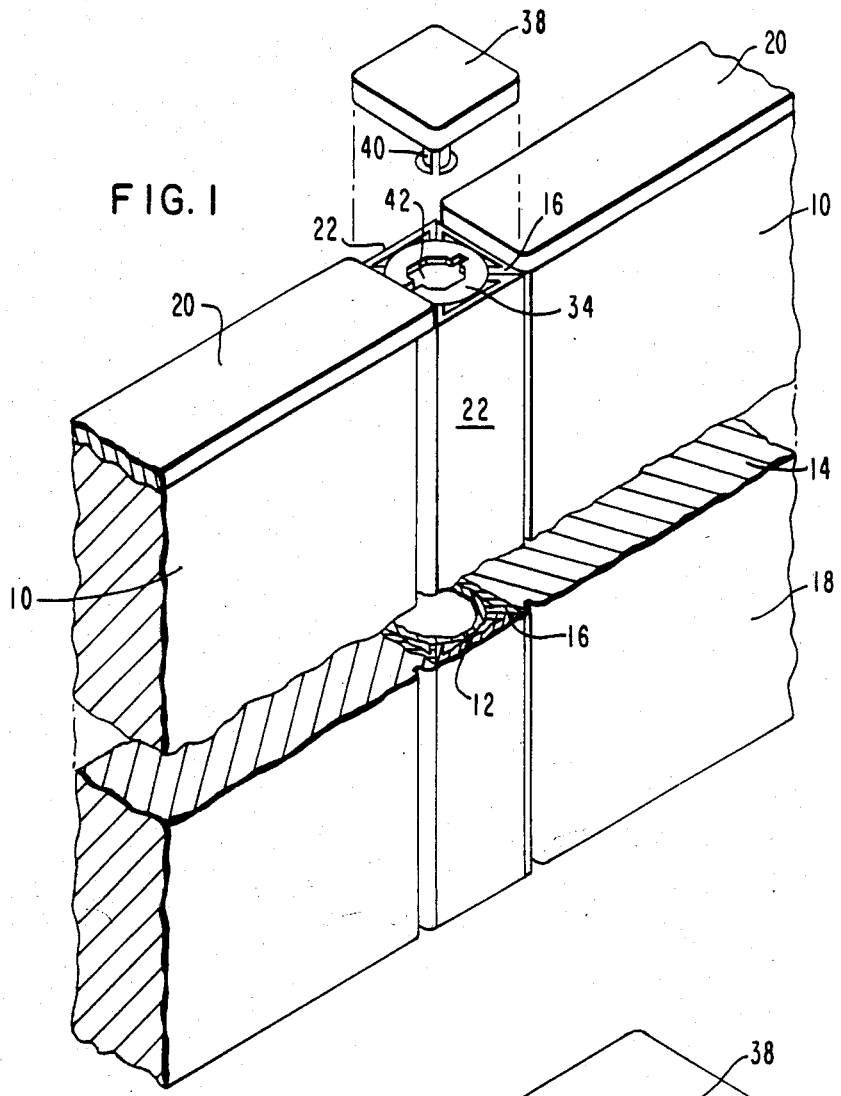
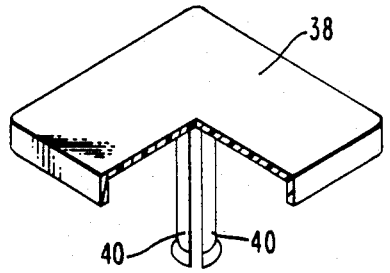
FIG. 4

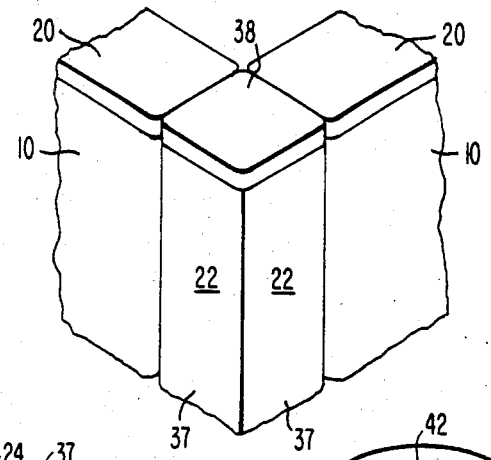
FIG.3
FIG.5
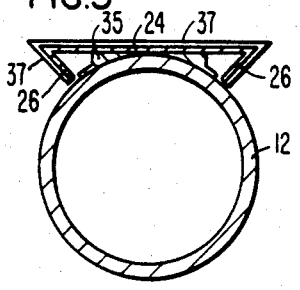
FIG.6
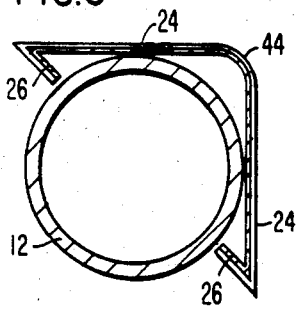
FIG.7
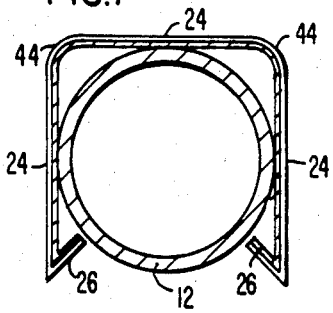
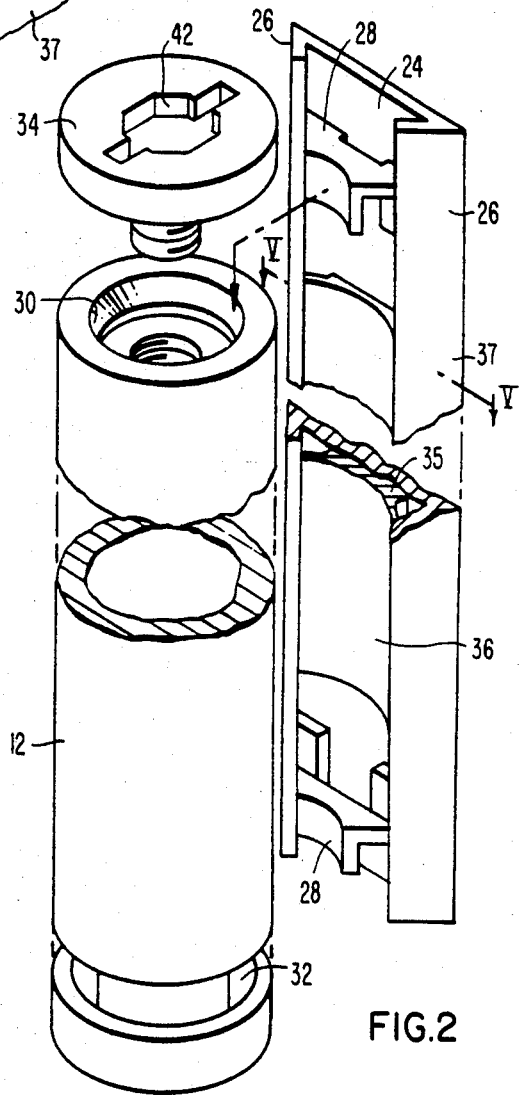
FIG.2

POST COVER FOR SPACE DIVIDING WALL PANEL SYSTEM

BACKGROUND OF THE INVENTION

This invention relates to space dividing wall panel systems of the type employed in the modern open office, and more particularly to a post cover for use in connection with space dividing wall panel systems employing cylindrical support posts to interconnect and support the space dividing wall panels. One such commercially successful space dividing wall panel system employing cylindrical support posts is disclosed in U.S. Pat. No. 3,762,116 to William C. Anderson et al. for Space Divider System And Connector Assembly Therefor. Although the modularity of the post and panel system as well as its ready adaptability for configuration modification in terms of minor changes to the office layout as well as substantial redesign of the entire office is a substantial asset, the aesthetic appeal of the system has sometimes been questioned.

It is accordingly the intention of the present invention to provide a means for eliminating the appearance of the round post interposed between adjacent space dividing wall panels as well as the appearance of a round post at the end of a panel wall. Furthermore, it has been found desirable to extend this aesthetic treatment to include a mechanism for disguising the round post cap which operates in combination with the cylindrical support post to retain the space dividing wall panel securely connected to the support post.

SUMMARY OF THE INVENTION

In accordance with the present invention a post cover is provided which either singularly or in combination with one or more identical post covers can be employed to shield totally from view the cylindrical support post of a space dividing wall panel system.

The foregoing is accomplished by providing a post cover which includes an elongated planar body portion having reentrant side flanges on each side edge thereof and a pair of vertically spaced, hook-shaped connectors secured to the inner surface of the body portion. These hook-shaped connectors are constructed and arranged to engage annular slots in a cylindrical support post of a space dividing wall panel system to thereby mount the post cover to the post. The post cover further includes retention means secured to the inner surface of the body portion intermediate the hook-shaped connectors which can take the form of an adhesive coated or metal impregnated, magnitized vinyl strip. The post cover may be employed singularly or in combination with one or more additional post covers to completely enclose the cylindrical support post in almost every post and panel configuration.

BRIEF DESCRIPTION OF THE DRAWING

Many of the attendant advantages of the present invention will become more readily apparent and better understood as the following detailed description is considered in connection with the accompanying drawing in which:

FIG. 1 is a perspective view, partly in section, of a space dividing wall panel system employing a cylindrical post in combination with the post cover of this invention;

FIG. 2 is a perspective view of a cylindrical support post and the post cover of this invention;

FIG. 3 is a perspective view similar to FIG. 1 with a pair of wall panels connected to a support post at right angles to each other;

FIG. 4 is a perspective view, partly in section, of the cap cover of this invention;

FIG. 5 is a section view taken along the line V—V- of FIG. 2;

FIG. 6 is a sectional view similar to FIG. 5 of an alternate embodiment of this invention; and FIG. 7 is a sectional view similar to FIG. 6 of another embodiment of this invention.

DESCRIPTION OF THE PREFERRED EMBODIMENT

Referring now in detail to the drawing, wherein like reference characters represent like parts throughout the several views, there is illustrated in FIG. 1 a pair of space dividing wall panels 10 interconnected and supported by a cylindrical support post 12 of the type disclosed in U.S. Pat. No. 3,877,191 to Robert J. Munsey for Connector Assembly and Support Post. The space dividing wall panels 10 generally include a core 14 which may be constructed in a plurality of different manners and from a number of different materials and generally includes steel slotted standards 16 at each lateral edge thereof and the panel outer surface 18 is usually a fabric covering but may, for some applications, be a decorative plastic laminate. The upper surface of the panel is generally a decorative vinyl top cap 20.

In accordance with the present invention, a post cover generally designated 22 is provided to shield the cylindrical support post 12 from view. The post cover, as best seen in FIG. 2, includes an elongated planar body portion 24 which is of substantially the same vertical height as the wall panels 10 and includes on its side edges reentrant flanges 26 which are angled inwardly at approximately 45° from the plane of the elongated body portion 24. A pair of vertically spaced, hook-shaped connectors 28 are secured, as for example by welding, to the inner surface of the planar body portion adjacent the top and bottom thereof and are spaced to be received by the annular openings or slots 30 and 32 in the cylindrical support post 12. The post cap 34, which conventionally secures the hook-shaped connectors on the space dividing wall panels in the slots 30 and 32, also acts in the same manner to secure and retain the hook-shaped connectors 28 on the post cover 22 in the slots or openings 30 and 32.

Because of the relative thinness of the elongated planar body portion 24 and the space between the hook-shaped connectors 28, it is preferable that the interior surface of the body portion 24 between the hook-shaped connectors 28 be provided with an elongated vinyl strip 35 having preferably an adhesive coated surface 36 or alternatively is impregnated with metal and magnetized and has a curved internal contour of substantially the same radius as the cylindrical support post 12. This adhesive coated or magnitized vinyl strip provides retentive contact between the post cover and the cylindrical support post over substantially the entire length of the post cover. The vinyl strip 35 may be secured to the internal surface of the body portion 22 by any suitable means and is preferably cemented thereto by a conventional contact cement.

In the preferred embodiment, the post cover is preferably 0.025 inch carbon steel and is covered on the outer surfaces of both the planar body portion 24 and reentrant flanges 26 with a fabric 37 of the same type, color and weave as the outer covering 18 on the space dividing wall panels. Should the wall panels have a decorative plastic laminate as the outer surface, the post cover can be provided with a matching or contrasting decorative plastic laminate on its outer surface in place of the fabric covering.

As can be seen in FIG. 1, a pair of post covers 22 may be employed to cover the exposed surfaces on each side of the linear run of space dividing wall panels 10 to provide an uninterrupted surface to the wall panel system. Where wall panels are connected at 90°, as illustrated in FIG. 3, again two post covers 22 are employed to shield the cylindrical post from view and also give the appearance of a smooth right angle at the corner. As will also be apparent from FIG. 3, if one of the wall panels 10 is not present and the support post is an end support post for a single panel, then the other panel illustrated in FIG. 3 could readily be replaced by a third post cover 22 to give a square appearance as opposed to a cylindrical appearance where the post not covered.

When the latter two configurations are assembled as opposed to the straight line configuration, the necessity for the juxtapositioning of two or more post covers will be apparent. In these configurations the reentrant flanges 26 on the side edges of adjacent post covers 22 will coact to provide lateral support for each other as well as ensuring that a substantially right angle relationship will be continuously maintained therebetween.

To continue with the squared appearance provided by the post covers 22, a plastic, preferably polypropylene, square post cap 38 illustrated in FIG. 4 is provided which has an edge thickness equivalent to the height of the panel cap 20 and includes on its underside a pair of centrally disposed split plastic leg portions 40 which are constructed to snap into and be retained in the tool slot 42 in the upper surface of the post cap 34 to further add a rectangular, as opposed to cylindrical, visual impression of the combination support post and panel array.

Alternatively, of course, the post cover of this invention could be manufactured as a unitary member for right angle connections such as FIG. 3 (FIG. 6) or end of run posts as a three sided post cover (FIG. 7) without departing from the scope of this invention. Additionally, the corners 44 could be slightly rounded as shown in FIGS. 6 and 7 if desired on a two sided or three sided unitary post cover. Obviously, hook shaped connectors 28 could be associated with one or more of the planar members making up the sides of the multi-sided post covers.

As will be apparent from the foregoing, the post covers of this invention along with the rectangular post cap can be readily adapted to existing space dividing wall panel systems. The threaded post cap 34 need merely to be removed from the support post and the post cover slipped into place as illustrated by the arrows in FIG. 2, the threaded post cap 34 resecured to the post 12 and the rectangular post cap 38 popped into the tool slot 42 to convert a cylindrical post and panel system to one having a continuous uninterrupted appearance.

We claim:

1. In a space dividing wall panel system including space dividing wall panels and cylindrical support posts, said cylindrical support posts having panel connecting and supporting annular slots therein, at least one space dividing wall panel supported by said annular slots, the improvement comprising:

one or more post covers having at least one inner and one outer planar surface secured to each of said cylindrical posts, said at least one inner surface having at least a pair of spaced, hook-shaped connectors thereon constructed and arranged to coact with the annular slots in said support post to thereby cover any exposed surface of said support post when said support post is supporting one or more space dividing wall panels.

2. The combination according to claim 1 wherein retention means is secured to the inner surface of said body portion intermediate said hook-shaped connectors.

3. The combination according to claim 2 wherein said retention means is a metal impregnated, magnetized vinyl strip.

4. The combination according to claim 2 wherein said retention means is an adhesive coated vinyl strip.

5. The combination according to claim 1 wherein the outer surface of said body portion are covered with a fabric.

6. The combination according to claim 1 wherein a plastic cap is releasably secured to the top end of said cylindrical post and overlies the upper edge of said post cover.

7. In combination with a space dividing wall panel system which includes at least a pair of spaced planar wall panels and a vertically oriented cylindrical support extending in a vertical dimension post having annular slots therein interconnecting and supporting said wall panels, a post cover which comprises:

an elongated planar body portion having inner and outer planar surfaces and extending for substantially the same vertical dimension as said support post;

a pair of vertically spaced hook-shaped connectors on the inner surface of said body portion constructed and engaging said annular slots in said cylindrical support post to thereby mount said post cover to said post, said post cover spanning the space between adjacent supported wall panels to thereby conceal said post, said outer surface of said post cover providing a continuous planar surface with said wall panels.

* * * * *